US005695196A

United States Patent [19]

Yanosky

[11] Patent Number: 5,695,196

[45] Date of Patent: Dec. 9, 1997

[54] PORTABLE TARGET ASSEMBLY

[76] Inventor: Michael H. Yanosky, 477 First Ave., Central City, Pa. 15926

[21] Appl. No.: 716,810

[22] Filed: Sep. 16, 1996

[51] Int. Cl.[6] ..... F41J 5/056

[52] U.S. Cl. ..... 273/406; 273/392

[58] Field of Search ..... 273/406, 390, 273/391, 392

[56] References Cited

U.S. PATENT DOCUMENTS

| | | | |
|---|---|---|---|
| 3,733,073 | 5/1973 | Gutler | 273/406 |
| 4,119,317 | 10/1978 | Ohlund et al. | 273/406 |
| 4,232,867 | 11/1980 | Tate, Sr. | 273/406 |
| 4,330,129 | 5/1982 | Meredith | 273/406 |
| 4,540,182 | 9/1985 | Clement | 273/406 |
| 5,240,258 | 8/1993 | Bateman | 273/406 |
| 5,403,017 | 4/1995 | Doss, III et al. | 273/406 |
| 5,433,451 | 7/1995 | De Vries | 273/406 |
| 5,533,732 | 7/1996 | Leinen, Sr. et al. | 273/406 |

*Primary Examiner*—Mark S. Graham

[57] ABSTRACT

A portable target assembly including a target plate having both a vertical orientation and a horizontal orientation. Further included is a drive mechanism adapted to effect raising of the target plate upon the receipt of a target raise signal and further effect lowering of the target plate upon the receipt of a target lower signal. For controlling the present invention, a control mechanism is adapted to transmit to the drive mechanism a target lower signal upon the target being hit. Also, the control mechanism is adapted to transmit to the drive mechanism a target raise signal upon the receipt of proper indication from a user with a hand-held transmitter. In an alternate embodiment, a timer is connected to the control mechanism in lieu of utilizing a transmitter. In such embodiment, the control mechanism is adapted to transmit to the drive mechanism a target raise signal after a predetermined amount of time after the target is hit.

1 Claim, 4 Drawing Sheets

FIG 3
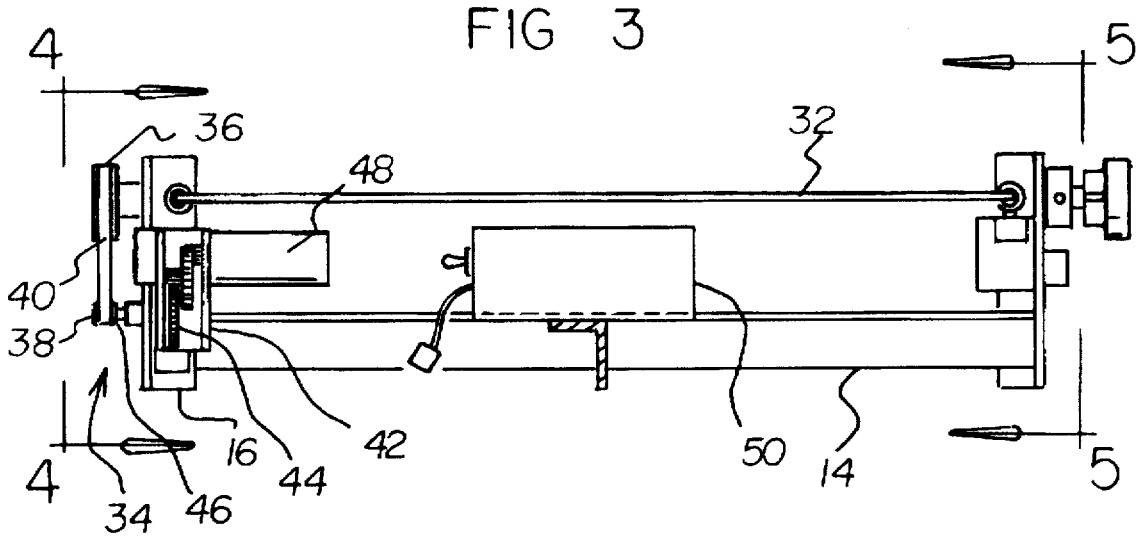
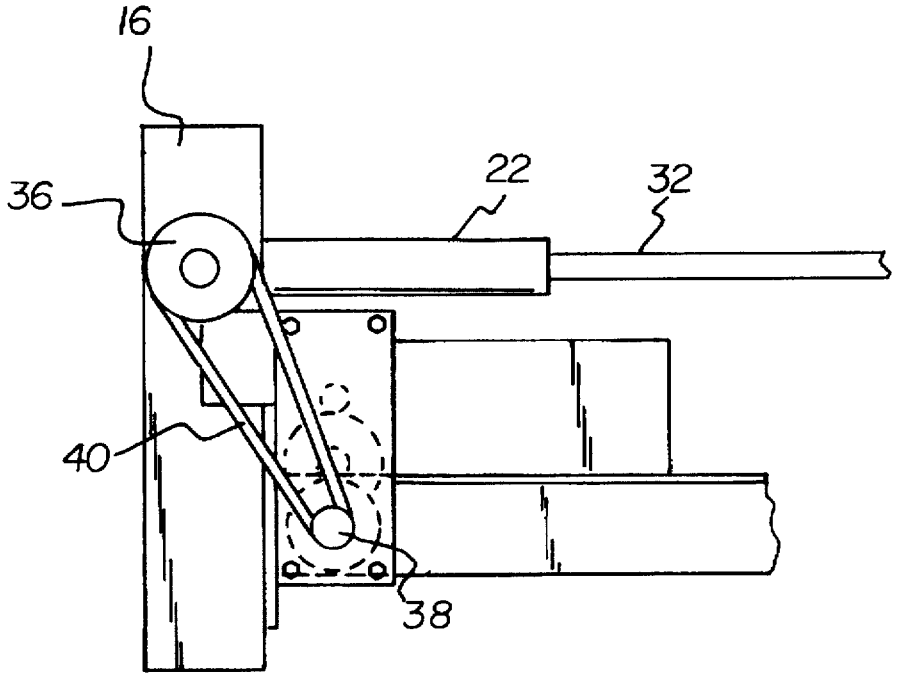
FIG 4

FIG 7
TIMER SCHEMATIC
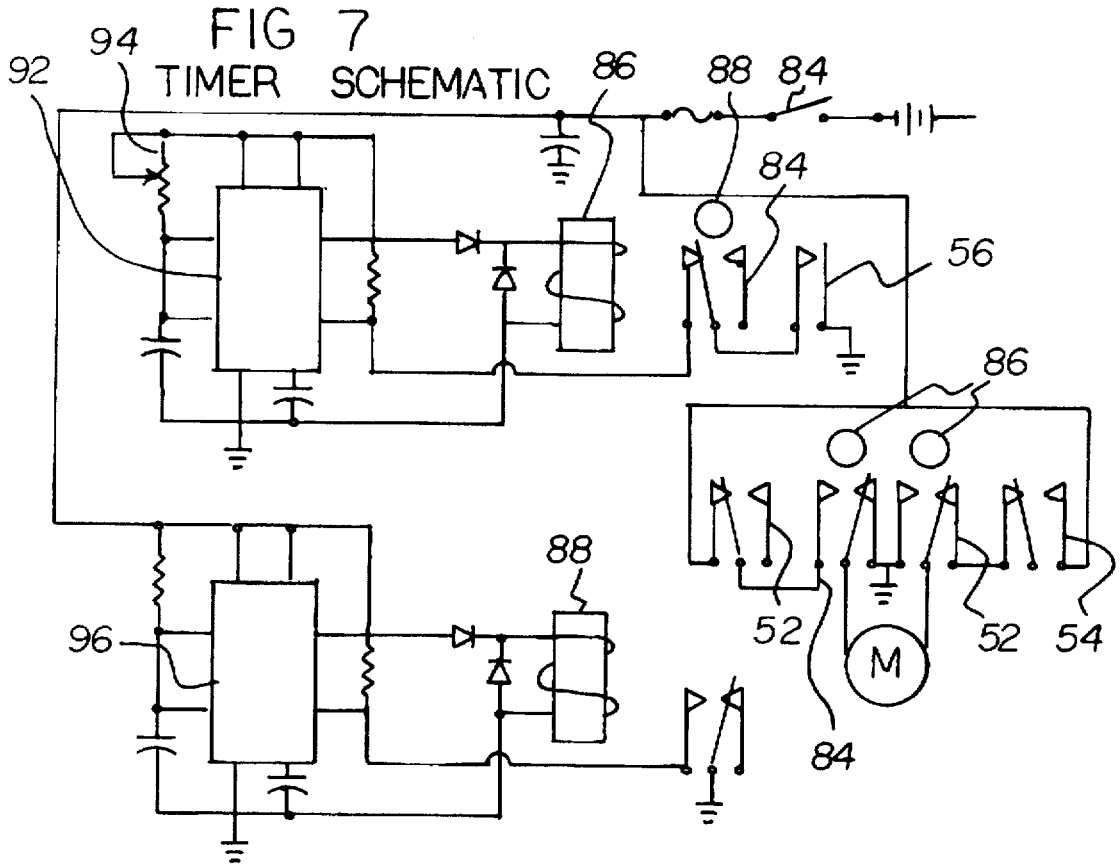
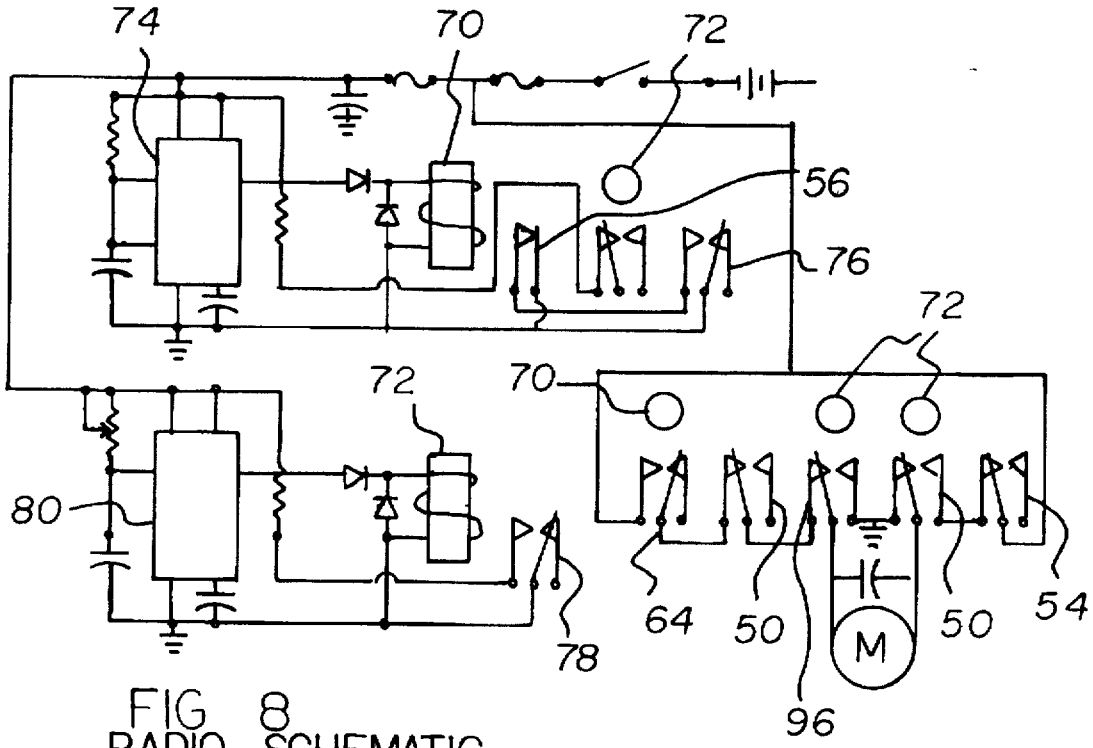
FIG 8
RADIO SCHEMATIC

PORTABLE TARGET ASSEMBLY

BACKGROUND OF THE INVENTION

1. Field of the Invention

The present invention relates to a portable target assembly and more particularly pertains to providing a uniquely designed portable target assembly that collapses when hit with a bullet and further may be either erected by remote control or via a timer.

2. Description of the Prior Art

The use of target assemblies is known in the prior art. More specifically, target assemblies heretofore devised and utilized for the purpose of allowing target practice are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,240,258 to Bateman; U.S. Pat. No. 4,714,256 to Mosser; U.S. Pat. No. 4,540,182 to Clement; U.S. Pat. No. 5,350,180 to Acock; U.S. Pat. No. 3,964,008 to Davis; and U.S. Pat. No. Des. 256,041 to Delude are provided as being of general interest.

In this respect, the portable target assembly according to the present invention substantially departs from the conventional concepts and designs of the prior art, and in so doing provides an apparatus primarily developed for the purpose of providing a uniquely designed portable target assembly that collapses when hit with a bullet and further may be either erected by remote control or via a timer.

Therefore, it can be appreciated that there exists a continuing need for a new and improved portable target assembly which can be used for providing a uniquely designed portable target assembly that collapses when hit with a bullet and further may be either erected by remote control or via a timer. In this regard, the present invention substantially fulfills this need.

SUMMARY OF THE INVENTION

In view of the foregoing disadvantages inherent in the known types of target assemblies now present in the prior art, the present invention provides an improved portable target assembly. As such, the general purpose of the present invention, which will be described subsequently in greater detail, is to provide a new and improved portable target assembly which has all the advantages of the prior art and none of the disadvantages.

To attain this, the present invention essentially comprises a portable target assembly. As best shown in FIG. 1, the portable target assembly includes a T-shaped base with a first elongated member perpendicularly coupled at a first end thereof to a midpoint of a second elongated member. Both members define a plane which resides horizontally adjacent a level surface. Further provided are a plurality of short angle irons vertically coupled to a second end of the first elongated member and further both ends of the second elongated member of the base. With reference still to FIG. 1, a target pivot mechanism is included having a horizontally situated rod pivotally coupled via pins to the angle irons of the second elongated member. As such, the rod is situated parallel to and slightly above the second elongated member. Fixed to opposite ends of the rod are a pair of target braces. Such braces are adapted to pivot between a first orientation wherein the target braces reside in a horizontal orientation and abut stoppers attached to each angle iron and a second orientation wherein the target braces are positioned vertically and abut the angle iron. A counter weight is also included. Associated therewith is a counter weight arm with a first end having a weight attached thereto and a second end coupled to the rod of target pivot mechanism. In operation, the weight has an elevated position when the target braces are in the first orientation thereof and a lowered position when the target braces are in the second orientation thereof. A target plate is fixed within grooves formed in the target braces. In use, the target plate is horizontally situated when the target braces are in the first orientation thereof and vertically situated when the target braces are in the second orientation thereof. Preferably, the target plate is formed of a lower portion with a generally rectangular configuration of a first size and further an upper portion with a generally rectangular configuration of a second size smaller than the first size. As best shown in FIGS. 3 & 4, a drive mechanism is provided. The drive mechanism includes a first pulley with a first diameter coaxially coupled to one of the ends of the rod of the target pivot mechanism. A second pulley with a second diameter less than the first diameter is pivotally coupled to the angle iron which the first pulley resides adjacent to. The second pulley is situated in a plane in which the first pulley resides. For allowing coincident rotation of the first pulley and the second pulley, a belt is situated about both. As best shown in FIG. 3, a gear box is situated on the angle iron on which the second pulley is attached. The gear box has a pin coaxially coupled to the second pulley. The gear box is also coupled to a motor. As such, the motor affords coincident geared down rotation of the first pulley upon the rotation of a rotor thereof. Specifically, the motor is adapted to effect raising of the target plate upon the receipt of a target raise signal and further effect lowering of the target plate upon the receipt of a target lower signal. For controlling the operation of the present invention, a control mechanism is included. The control mechanism includes a first switch shown in FIGS. 2 & 5 to be situated on one of the stoppers of the target assembly. The first switch transmits a target lowered signal upon the target plate being horizontally situated. Situated on one of the angle irons is a second switch for transmitting a target raised signal upon the target plate being vertically situated. A vibration sensor is coupled to a lower extent of the target plate and is adapted to transmit a hit signal upon the target plate being shot with a bullet by a user. Control circuitry is connected to the motor, the first switch, the second switch, and the vibration sensor. Such control circuitry is adapted to transmit a target raise signal to the motor upon the receipt of a target raise control signal until the receipt of the target raised signal from the second switch. In addition, the control circuitry is adapted to transmit to the motor a target lower signal upon the receipt of the hit signal from the vibration sensor until the receipt of the target lowered signal from the first switch. Finally, in the first embodiment, a transmitter with a hand-held, box-shaped housing is included. See FIG. 6. The transmitter is adapted to transmit via free space a target raise control signal upon depression of a raise button situated thereon. In an alternate embodiment, a timer is connected to the control mechanism in lieu of the transmitter. In such embodiment, the timer is adapted to transmit to the control mechanism a target raise control signal after a predetermined amount of time after the target is hit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable target assembly which has all the advantages of the prior art target assemblies and none of the disadvantages.

It is another object of the present invention to provide a new and improved portable target assembly which may be easily and efficiently manufactured and marketed.

It is a further object of the present invention to provide a new and improved portable target assembly which is of a durable and reliable construction.

An even further object of the present invention is to provide a new and improved portable target assembly which is susceptible of a low cost of manufacture with regard to both materials and labor, and which accordingly is then susceptible of low prices of sale to the consuming public, thereby making such portable target assembly economically available to the buying public.

Still yet another object of the present invention is to provide a new and improved portable target assembly which provides in the apparatuses and methods of the prior art some of the advantages thereof, while simultaneously overcoming some of the disadvantages normally associated therewith.

Still another object of the present invention is to provide a uniquely designed portable target assembly that collapses when hit with a bullet and further may be either erected manually or via a timer.

Lastly, it is an object of the present invention to provide a new and improved portable target assembly including a target plate having both a vertical orientation and a horizontal orientation. Further included is a drive mechanism adapted to effect raising of the target plate upon the receipt of a target raise signal and further effect lowering of the target plate upon the receipt of a target lower signal. For controlling the present invention, a control mechanism is adapted to transmit to the drive mechanism a target lower signal upon the target being hit. Also, the control mechanism is adapted to transmit to the drive mechanism a target raise signal upon the receipt of proper indication from a user with a hand-held transmitter. In an alternate embodiment, a timer is connected to the control mechanism in lieu of utilizing a transmitter. In such embodiment, the control mechanism is adapted to transmit to the drive mechanism a target raise signal after a predetermined amount of time after the target is hit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of the present invention.

FIG. 4 is a close-up side view of the drive mechanism of the present invention.

FIG. 7 is a schematic of the control mechanism of the alternate embodiment of the present invention.

FIG. 8 is a schematic of the control mechanism of the preferred embodiment of the present invention.

Similar reference characters refer to similar parts throughout the several views of the drawings.

DESCRIPTION OF THE PREFERRED EMBODIMENT

Figure 1:
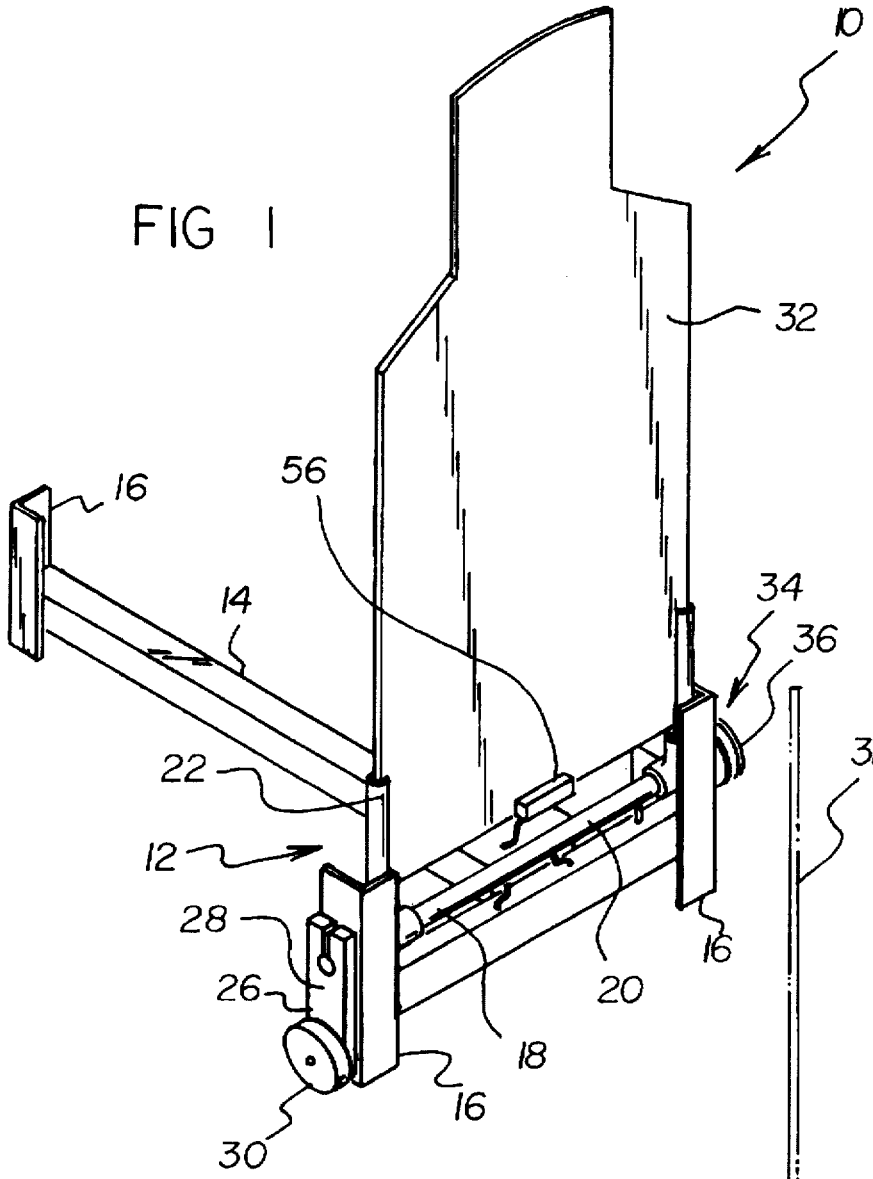
FIG. 1 is a perspective illustration of the preferred embodiment of the portable target assembly constructed in accordance with the principles of the present invention.

With reference now to the drawings, and in particular to FIG. 1 thereof, a new and improved portable target assembly embodying the principles and concepts of the present invention and generally designated by the reference numeral 10 will be described.

The present invention, the new and improved portable target assembly, is comprised of a plurality of components. Such components in their broadest context include a target assembly, drive mechanism, and control mechanism. Such components are individually configured and correlated with respect to each other so as to attain the desired objective.

More specifically, it will be noted that the system 10 of the present invention includes a portable target assembly 12 preferably constructed mainly of a rigid metal. As best shown in FIG. 1, the portable target assembly includes a T-shaped base 14 with a first elongated member perpendicularly coupled at a first end thereof to a midpoint of a second elongated member. Both members define a plane which resides horizontally adjacent a level surface. Ideally, the first elongated member is more than twice the length of the second elongated member. Further provided are a plurality of short angle irons 16 vertically coupled to a second end of the first elongated member and further both ends of the second elongated member of the base. The angle irons are adapted to elevate the base slightly above the ground.

With reference still to FIG. 1, a target pivot mechanism 18 is included having a horizontally situated rod 20 pivotally coupled via pins to the angle irons of the second elongated member. As such, the rod is situated parallel to and slightly above the second elongated member. Fixed to opposite ends of the rod are a pair of target braces 22. Such braces are adapted to pivot between a first orientation wherein the target braces reside in a horizontal orientation and abut stoppers 24 attached to each angle iron and a second orientation wherein the target braces are positioned vertically and abut the angle iron. A counter weight 30 is also included. Associated therewith is a counter weight arm 28 with a first end having a weight 30 attached thereto and a second end coupled to the rod of target pivot mechanism. In operation, the weight has an elevated position when the target braces are in the first orientation thereof and a lowered position when the target braces are in the second orientation thereof.

Yet another component of the portable target assembly is a target plate 32. The target plate is fixed within grooves formed in the target braces. In use, the target plate is horizontally situated when the target braces are in the first orientation thereof and vertically situated when the target braces are in the second orientation thereof. It should be noted that the angle iron of the first elongated rod serves as a rest for the target plate when horizontally oriented. Also, the counterweight works to allow effortless raising of the target plate. Preferably, the target plate is formed of a lower portion with a generally rectangular configuration of a first size and further an upper portion with a generally rectangular configuration of a second size smaller than the first size.

As best shown in FIGS. 3 & 4, a drive mechanism 34 is provided. The drive mechanism includes a first pulley 36 with a first diameter coaxially coupled to one of the ends of the rod of the target pivot mechanism. A second pulley 38 with a second diameter less than the first diameter is pivotally coupled to the angle iron adjacent to which the first pulley resides. The second pulley is situated in a plane in which the first pulley resides. For allowing coincident rotation of the first pulley and the second pulley, a belt 40 is situated about both. Preferably, the belt and pulley have interlocking grooves for precluding slippage. As best shown in FIG. 3, a gear box 42 including a plurality of gears 44 is situated on the angle iron on which the second pulley is attached. The gear box has a pin 46 coaxially coupled to the second pulley. The gear box is also coupled to a motor 48. As such, the motor affords coincident geared down rotation of the first pulley upon the rotation of a rotor thereof. Specifically, the motor is adapted to effect raising of the target plate upon the receipt of a target raise signal and further effect lowering of the target plate upon the receipt of a target lower signal.

Figure 2:
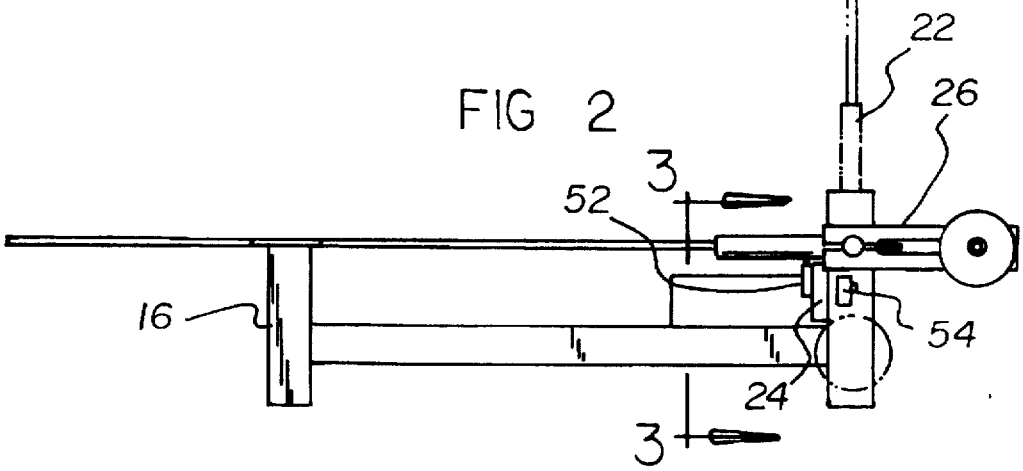
FIG. 2 is a side view of the present invention.
Figure 5:
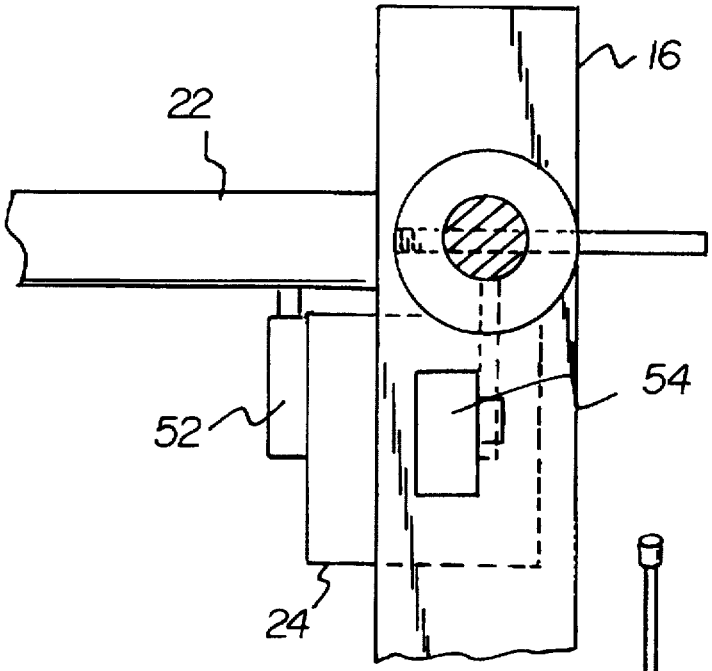
FIG. 5 is a close-up side view of the present invention depicting the first and second switches.

For controlling the operation of the present invention, a control mechanism 50 is included. The control mechanism includes a first switch 52 shown in FIGS. 2 & 5 to be situated on one of the stoppers of the target assembly. The first switch transmits a target lowered signal upon the target plate being horizontally situated. Situated on one of the angle irons is a second switch 54 for transmitting a target raised signal upon the target plate being vertically situated. A vibration sensor 56 is coupled to a lower extent of the target plate and is adapted to transmit a hit signal upon the target plate being shot with a bullet by a user. Control circuitry is connected to the motor, the first switch, the second switch, and the vibration sensor. Such control circuitry is adapted to transmit a target raise signal to the motor upon the receipt of a target raise control signal until the receipt of the target raised signal from the second switch. In addition, the control circuitry is adapted to transmit to the motor a target lower signal upon the receipt of the hit signal from the vibration sensor until the receipt of the target lowered signal from the first switch. As such, the first and second switches act as deactivation mechanisms for identifying when the target plate is the proper position. For portable powering purposes, the control mechanism is equipped with a rechargeable battery.

Figure 6:
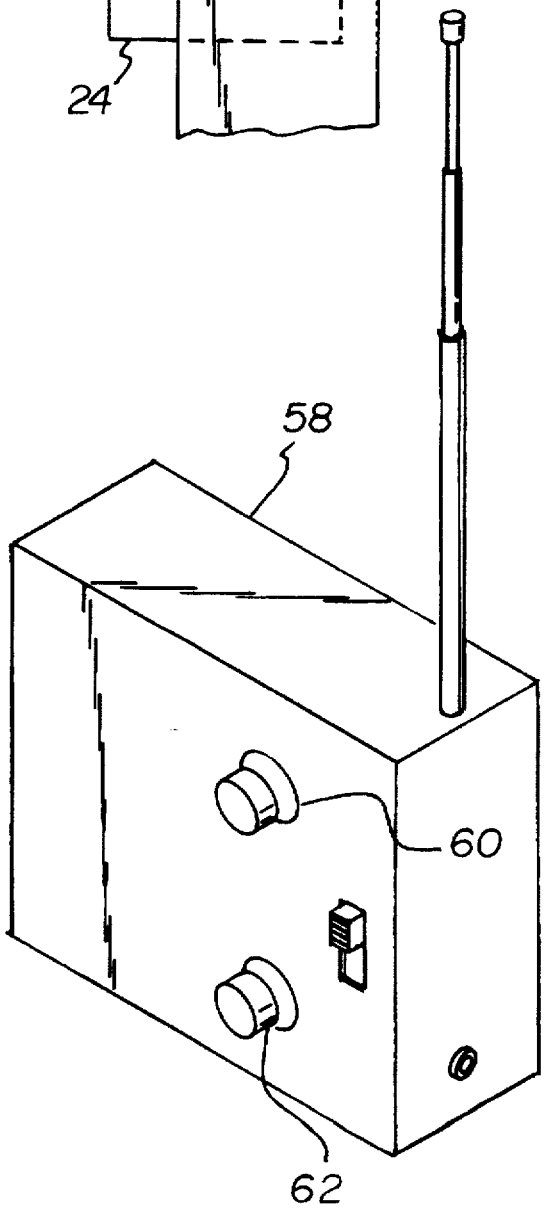
FIG. 6 is a perspective view of the transmitter of the present invention.

Finally, in the first embodiment, a transmitter 58 with a hand-held, box-shaped housing is included. See FIG. 6. The transmitter is adapted to transmit via free space a target raise control signal upon depression of a raise button 60 situated thereon. The transmitter further includes a lower button 62 for allowing the transmitter to deploy a lower control signal via free space upon the depression thereof. To accommodate such lower button, the control circuitry is further adapted to transmit to the motor a target lower signal upon the receipt of the lower control signal until the receipt of the target lowered signal from the first switch. Such button thus allows an additional means of lowering the target plate. The transmitter is further equipped with an antenna for allowing transmission of the associated signals over great distances of approximately 100 yards.

To provide a more specific description of the control mechanism, reference is taken to FIG. 8. From such FIG., it is noted that the first switch, the second switch, and the vibration sensor are connected in series with the motor and a power switch 64. It should be noted that the first switch and power switch have dual functions in the schematic shown. As such, they are shown twice. Switch 64 has an associated relay 70. Switches 50 and 96 have an associated relay 72. It should also be noted that the relays are shown more than once to show both the proper connection and the proper placement without sacrificing clarity. In use, a bullet hit is detected by the vibration sensor 56 which, in turn, triggers a 555 timer 74. The 555 timer 74 then employs relay 70 for transmitting the lower signal to the motor via switch 64. This occurs until switch 52 is abutted by the target plate. When lowering the target plate using the transmitter, the transmission of the lower control signal from the transmitter closes switch 76 which activates the 555 timer 74 in a manner similar to that described above. As shown in the schematic, the lower signal is transmitted until the first switch is closed. To raise the target plate, the raise control signal is transmitted from the transmitter. Such signal closes switch 78 which activates 555 timer 80 which, in turn, energizes relay 72 thus transmitting the raise signal to the motor via switches 50, 54, and 96. This occurs until switch 54 is abutted by the target plate.

In an alternate embodiment, a timer is connected to the control mechanism in lieu of the transmitter. In such embodiment, the timer is adapted to transmit to the control mechanism a target raise control signal after a predetermined amount of time after the target is hit.

To provide a more specific description of the control mechanism of the alternate embodiment, reference is taken to FIG. 7. From such FIG., is noted that the first switch 54 and switch 50 are connected in series with the motor and a power switch 82. Switches 50 and 84 have an associated relay 86. Furthermore, the power switch is situated adjacent an associated relay 88. In use, when the power switch is actuated, a 555 timer 92 triggers relay 86 which, in turn, allows the transmission of the raise signal to the motor via switches 54 and 50 until the first switch 54 is actuated. Similar to the preferred embodiment, when the target plate is hit with a bullet, the vibration switch triggers a 555 timer 92 which energizes relay 86. Such relay 86 then closes switches 50 and 84 thereby transmitting a lower signal to the motor until the second switch 52 is actuated. After a timer clock down determined primarily by potentiometer 94, the power to the motor is reversed until the first switch is abutted. It should be noted that the vibration sensor is disabled by a 555 timer 96 and the associated relay 88. Such disablement occurs while the target plate is rising to prevent false triggering of the 555 timer 92 during a time period of approximately 2 seconds after the target plate is raised.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved portable target assembly comprising, in combination:

a portable target assembly including a T-shaped base with a first elongated member perpendicularly coupled at a first end thereof to a midpoint of a second elongated member wherein both members define a plane which resides horizontally adjacent a level surface and the first elongated member is more than twice the length of the second elongated member, a plurality of short angle irons vertically coupled to a second end of the first elongated member and further both ends of the second elongated member of the base with the short angle irons adapted to elevate the base slightly above ground, and a target pivot mechanism having a horizontally situated rod pivotally coupled via pins at both ends thereof to the angle irons of the second elongated member such that the rod is situated parallel to and slightly above the second elongated member, a pair of target braces fixed to opposite ends of the rod and adapted to pivot between a first orientation wherein the target braces reside in a horizontal orientation and abut stoppers attached to each angle iron and a second orientation wherein the target braces are positioned vertically and abut the angle iron, a counter weight including a counter weight arm with a first end having a weight attached thereto and a second end coupled to the rod of target pivot mechanism, wherein the weight has an elevated position when the target braces are in the first orientation thereof and a lowered position when the target braces are in the second orientation thereof, the target assembly further including a target plate formed of a lower portion with a generally rectangular configuration of a first size and further an upper portion with a generally rectangular configuration of a second size smaller than the first size, wherein the target plate is fixed within grooves formed in the target braces and is horizontally situated when the target braces are in the first orientation thereof and vertically situated when the target braces are in the second orientation thereof, wherein the angle iron connected to the first elongated member serves as a rest for the target plate when horizontally oriented;

a drive mechanism including a first pulley with a first diameter coaxially coupled to one of the ends of the rod of the target pivot mechanism, a second pulley with a second diameter less than the first diameter pivotally coupled to one of the angle irons in a plane in which the first pulley resides, a belt situated about both pulleys for allowing coincident rotation thereof with the belt and the pulleys having grooves to prevent slippage, a gear box situated on the angle iron on which the second pulley is attached with a pin coaxially coupled to the second pulley, the gear box further coupled to a motor for affording coincident geared down rotation of the first pulley upon the rotation of a rotor thereof, whereby the motor is adapted to effect raising of the target plate upon the receipt of a target raise signal and further effect lowering of the target plate upon the receipt of a target lower signal;

a control mechanism comprising a first switch situated on one of the stoppers of the target assembly for transmitting a target lowered signal upon the target plate being horizontally situated, a second switch situated on one of the angle irons for transmitting a target raised signal upon the target plate being vertically situated, a vibration sensor coupled to a lower extent of the target plate and adapted to transmit a hit signal upon the target plate being shot with a bullet by a user, and control circuitry connected to the motor, the first switch, the second switch, and the vibration sensor, the control circuitry adapted to transmit a target raise signal to the motor upon the receipt of a target raise control signal until the receipt of the target raised signal from the second switch, the control circuitry further adapted to transmit to the motor a target lower signal upon the receipt of the hit signal from the vibration sensor until the receipt of the target lowered signal from the first switch;

a rechargeable battery for portable powering purposes;

a transmitter with a hand-held, box-shaped housing adapted to transmit via free space a target raise control signal upon depression of a raise button situated thereon and transmit via free space a target lower control signal upon depression of a lower button situated thereon; and whereby upon a bullet hit being detected by the vibration sensor, the vibration sensor triggers a first 555 timer of the control circuitry which in turn employs a relay of the control circuitry for transmitting the target lower signal to the motor, whereby upon the receipt of the raise control signal, a second 555 timer of the control circuitry employs another relay for transmitting the target raise signal to the motor.

* * * * *